United States Patent [19]

Engfer

[11] Patent Number: 4,972,819

[45] Date of Patent: Nov. 27, 1990

[54] SERVOCYLINDER UNIT

[75] Inventor: Ortwin Engfer, Stuttgart, Fed. Rep. of Germany

[73] Assignee: Robert Bosch GmbH, Stuttgart, Fed. Rep. of Germany

[21] Appl. No.: 271,753

[22] PCT Filed: Feb. 26, 1987

[86] PCT No.: PCT/DE87/00070

§ 371 Date: Sep. 14, 1988

§ 102(e) Date: Sep. 14, 1988

[87] PCT Pub. No.: WO87/05660

PCT Pub. Date: Sep. 24, 1987

[30] Foreign Application Priority Data

Mar. 22, 1986 [DE] Fed. Rep. of Germany ..... 3609838

[51] Int. Cl.[5] ..... F02M 39/00

[52] U.S. Cl. ..... 123/370; 123/372; 123/385; 180/197

[58] Field of Search ..... 123/370, 372, 385, 386, 123/387; 180/197

[56] References Cited

U.S. PATENT DOCUMENTS

| | | | |
|---|---|---|---|
| 2,897,809 | 8/1959 | Forster | 123/385 |
| 2,914,056 | 11/1959 | Hughson | 123/372 |
| 4,262,642 | 4/1981 | Sverdlin | 123/385 |
| 4,706,627 | 11/1987 | Eltze | 123/370 |
| 4,745,900 | 5/1988 | Thudt | 123/372 |
| 4,779,591 | 10/1988 | Tordenmalm | 123/357 |

FOREIGN PATENT DOCUMENTS

| | | | |
|---|---|---|---|
| 2015258 | 10/1970 | Fed. Rep. of Germany | 123/385 |
| 2454061 | 6/1975 | Fed. Rep. of Germany | 123/370 |
| 3122666 | 1/1983 | Fed. Rep. of Germany | 123/370 |
| 3125127 | 8/1984 | Fed. Rep. of Germany | 123/370 |

*Primary Examiner*—Carl Stuart Miller

*Attorney, Agent, or Firm*—Michael J. Striker

[57] ABSTRACT

A servocylinder unit for adjusting an amount of fuel fed to a vehicle drive engine and comprising a piston displaceable in a cylinder, a first pre-stressed spring for biasing the piston to its initial position, a first stop for supporting the first spring and displaceable along the longitudinal axis of the cylinder, a second pre-stressed spring extending between the first stop and a base of the cylinder, and a second stop fixed to the cylinder and engageable by the first stop under bias of the second spring. The first spring enables regulation of a number of revolutions of the vehicle engine, and the second spring, which has a larger pre-stress than the first spring and is less rigid than the first spring, is compressible to enable switching off of fuel feeding.

4 Claims, 2 Drawing Sheets

SERVOCYLINDER UNIT

BACKGROUND OF THE INVENTION

The invention relates to a servocylinder unit for adjusting an amount of fuel fed to a vehicle drive engine. The periodical "Ingenieurs de l'Automobile" [Automotive Engineers], Oct. 1984, page 115, discloses a servocylinder unit installed in a rod linkage located between a pedal and an adjusting lever of a diesel injection pump. A medium, e.g., compressed air acts on the piston of the servocylinder unit automatically against the bias of a pre-stressed compression spring when an excessive drive slippage occurs at the drive gears of a motor vehicle. The compression spring is partially compressed by a load acting on the piston, so that the length of the rod linkage changes, resulting in a reduction of the amount of injected fuel which the diesel injection pump feeds to a drive motor of the motor vehicle. If the load on the piston is increased to the extent that the compression spring is almost completely compressed, the piston provides for switching off of the diesel injection pump and stopping feed of the fuel to the drive motor. It has been recognized that a hard compression spring is favorable for a sensitive regulation of the drive slippage. However, this has the disadvantage that it makes the switching off of the diesel injection pump unnecessarily difficult because either a high load pressure is needed for the piston or a large piston diameter is needed which more constructional space and results in higher production costs.

DE-PS 33 23 563 disclose a control device for limiting the number of revolutions and speed of a drive motor of a motor vehicle. This control device likewise employs a servocylinder unit, which includes a piston and a pretensioned compression spring, and is installed a rod linkage of a diesel injection pump to reduce the amount of the injected fuel. This servocylinder is also used for switching off the diesel injection pump. A servocylinder and a valve arrangement located upstream thereof and forming a part of a control device, can likewise be used for reducing fuel delivery and accordingly the drive slippage.

German Pat. No. 3,122,666 discloses a servocylinder unit which is installed in a rod linkage and comprises an outer cylinder, an annular piston, an inner cylinder located in said annular piston, and a second piston displaceable in the inner cylinder. The servocylinder unit comprises two pre-stressed compression springs for displacing the annular piston relative to the outer cylinder and the second piston relative to the inner cylinder, respectively, to their respective initial positions. The outer cylinder has two control terminals for two opposite sealed load chambers cooperating with the annular piston and the second piston, respectively. The chamber cooperating with the annular piston provides for shorting of the rod linkage and, thus, for switching off of the injection pump. A loading of the piston located in the inner cylinder through a pedal controlled valve and a throttle associated therewith causes a gradual compression of the compressing spring to provide for a gradual increase in the amount of injected fuel to effect a noiseless acceleration of the vehicle. Thus, DE-A-3,122,666 teaches combining two independent arrangements each comprising a cylinder, a piston, and a pressure spring in a single unit.

SUMMARY OF THE INVENTION

The servocylinder unit, according to the invention, comprises two springs having different working forces, respectively, for resisting displacement of the piston of the servocylinder unit and two stops cooperating one stop is displaceable. The servocylinder unit enables a sensitive regulation of a number of revolutions for protection against drive slippage, on one hand, and, on the other hand, it requires only a small increase in a load acting on its piston for switching off the diesel injection pump. Accordingly, with a predetermined maximum loading pressure, which is predetermined by a pump which is installed in the motor vehicle, the piston diameter can be selected so as to be relatively small, so that the installation of the servocylinder unit in the motor vehicle is facilitated and production costs are reduced.

According to another feature of the invention the displaceable stop is formed as an annular member which surrounds the piston rod of the servocylinder unit with a clearance therebetween. In accordance with still another feature of the invention, the servocylinder has two coaxial bores and a shoulder which separates the two bores serves as a fixed stop for the axially movable stop. In accordance with yet another feature of the invention, the axially movable stop includes a bushing which limits compression of at least one of the two compression springs.

BRIEF DESCRIPTION OF THE DRAWINGS

The invention itself, however, both as to its construction and its method of operation, together with additional objects and advantages thereof, will be best understood from the following description of the preferred embodiment with references to the appended drawings wherein.

DESCRIPTION OF THE PREFERRED EMBODIMENT

Figure 1:
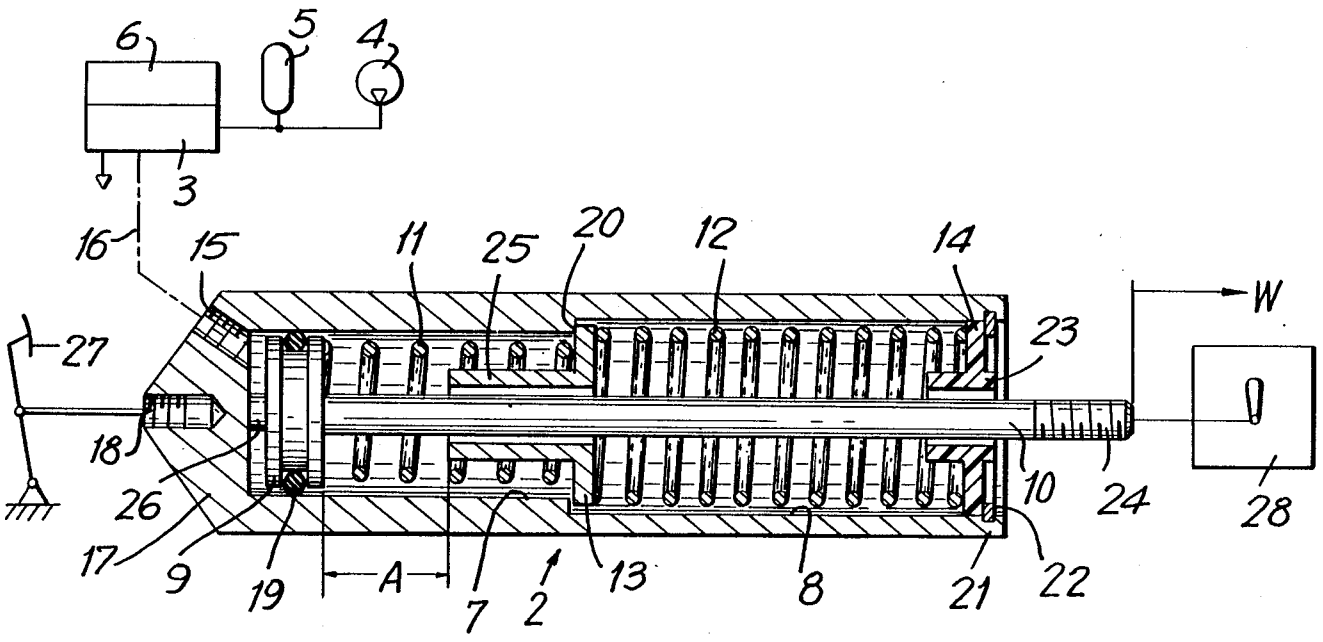
FIG. 1 shows a longitudinal cross-sectional view of a servocylinder unit according to the invention.

As shown in FIG. 1, a servocylinder unit 2 according to the invention is connected to a valve arrangement 3 which communicates with a storage 5 chargeable by a pump 4. A pump for supplying a compressed air braking system can serve as the pump 4. The valve arrangement 3 can be formed in a manner disclosed in the periodical "Ingenieurs de l'Automobile" [Automotive Engineers], 1984, page 115, and controlled by a drive slippage governor 6 described therein. Instead of the 3/2-way valve disclosed in this periodical, a valve arrangement described in DE-PS 33 23 563 can also be used, by means of which the pressure medium consumption can be reduced.

The servocylinder unit comprises a cylinder 2 having two coaxial bores 7 and 8 having different diameters, a piston 9, a piston rod 10, a first compression spring 11 which regulates drive slippage, a second compression spring 12, an axially displaceable stop 13, and a cylinder part or base 14.

The bore 7 is a blind bore and defines a cylinder chamber which is connected to the valve arrangement 3 via a connection bore 15 and a flexible conduit 16. A threaded hole 18 is drilled in a cylinder end portion 17 located behind the bottom of the bore 7. A part, not shown, of a rod linkage, which is located between a gas pedal 27 and a diesel injection pump 28 or another adjustable fuel delivery system, is screwed into this threaded hole 18. The piston 9 is displaceable in the bore 7 and comprises a sealing ring 19 for sealing relative to the bore 7. The bore 8 is located adjacent and to the bore 7 8 has a larger diameter than the bore 7. As a result of a difference in the diameters of the bores 7 and 8, a shoulder 20 is formed in the cylinder 2. The bore 8 defines an open end 21 of the cylinder 2. At the open end 21, a retaining ring 22 holds the cylinder base 14 in the cylinder 2. The cylinder base 14 has a guide bush 23 for the piston rod 10 which projects out of the cylinder 2 and has a threaded connection portion 24. The guide bush 23 is coaxial with the cylinder 2.

The shoulder 20 is an annular surface which serves within the framework of the invention as an axial stop which is rigidly connected with the cylinder 2. The axially displaceable stop 13 cooperates with this rigid axial stop 20 and has a diameter which is greater than that of the bore 7, but smaller than that of the bore 8. The axially displaceable stop 13 is formed of an annular disk member and bush 25 attached thereto and facing the piston 9. The compression spring 12 is inserted between the axially displaceable stop 13 and the cylinder base 14. It biases the axially displaceable stop 13 against the shoulder 20. The compression spring 11 is inserted between the axially displaceable stop 13 and the piston 9 and encloses the piston rod 10 and also the bush 25 with a clearance. In the end position of the piston 9, shown in the drawing, in which a projection 26 of the piston 9 rests on the end portion 17 of the cylinder 2, the piston 9 is spaced from the bush 25 by a distance A. A threaded connection portion 24 of the piston rod 10 extends in the direction of arrow W.

Figure 2:
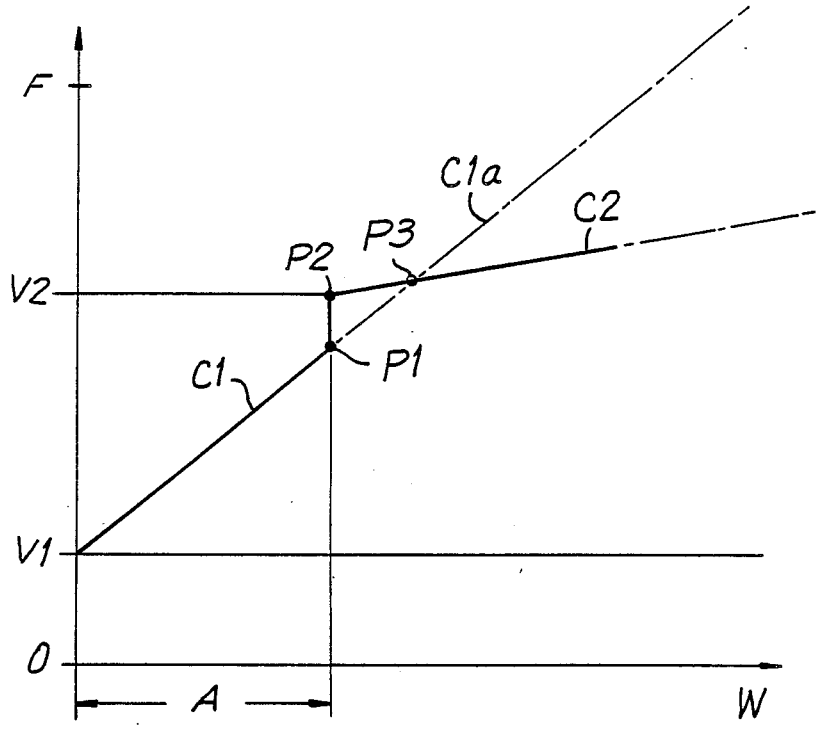
FIG. 2 shows a diagram of a force characteristic line of a spring combination in the servocylinder unit according to FIG. 1.

Wires, from the which the compression springs 11 and 12 are coiled, have the same wire diameter, for example. However, the coil radii of the two compression springs 11 and 12 differ. The compression spring 12 has e.g., approximately twice as many turns as the compression spring 11. Both compression springs 11 and 12 are installed in the cylinder 2 in a pre-stressed state. The configuration of the forces F of two compression springs 11 and 12 is shown over the path W in the path-force diagram according to FIG. 2. The compression spring 11 has a pre-stress V1. When a very small pressure, e.g. air pressure, acts upon the piston 9, the piston 9 first remains in the initial position shown in the drawing. Only when the load has reached a magnitude which overcomes the force V1 of the pre-stressed compression spring 11, is the latter compressed, an the piston 9 moves the piston rod 10 in the direction of the arrow W. In so doing, the compression spring 11 opposes the piston 9 with an increasing force. The qualitative dependence of the increase in force F as the path W of the piston rod becomes greater is shown in FIG. 2 by an ascending straight line C1. The straight line C1 ends at a point P1. Until then, the piston 9 had run through the path A in the direction of the bush 25. The bush 25 limits the compression of the compression spring 11.

The compression spring 12 is pre-stressed with a force V2 which lies at a point P2 in the diagram according to FIG. 2 which is located vertically over the point P1. As a result, it is necessary that the load acting on the piston 9 be increased further after the piston 9 abuts 25 in order to overcome the force V2 of the spring 12. When the load is further increased, the piston 9 displaces the axially displaceable stop 13 against the force of the compression spring 12. The resulting increase of force of the compression spring 12 as a function of the path W is likewise shown in the form of a straight line designated by C2. The inclination of the straight line C2 is less than that of the straight line C1. When a straight line C1*a* is plotted as an extension of the straight line C1, the straight lines C2 and C1*a* intersect at a point P3. The straight lines C2 and C1*a* diverge rightward of the point P3. Thus, the diagram shows that a steep increase in load of the piston 9 is necessary first in order to displace the piston rod 10, whereas, later, a load acting upon the piston 9, which load increases relatively little, effects relatively large displacements of the piston rod 10.

The distance A is preferably selected in such a way that a displacement of the piston rod 10 relative to the cylinder 2 results in a reduction in an amount of injected fuel substantially until an idling injection amount is attained when the cylinder 2 is located between a fully depressed pedal and the diesel injection pump. Adjusting is possible for limiting or reducing drive slippage when the piston is displaceable along path A. Therefore, the compression spring 11 can also be used for regulating the number of revolution. As already indicated in the beginning, the spring 11 is constructed so as to be relatively rigid for the purpose of a sensitive regulation of drive slippage.

The displacement of the piston rod along the path W is required in order to switch off the diesel injection pump. As it has been already indicated, the path W of the piston rod is greater than the path A along which the piston 9 can travel relative to the bush 25. Thus, in order to switch off the diesel injection pump, the load on the piston 9 must be increased to the extent that at least the force V2 of the compression spring 12, which is present as a result of pre-stress, is overcome. Thus, it can also be seen that only an excess load, which acts on the piston 9, generates those forces at the piston rod 10 which can be utilized for switching off the diesel injection pump. As a result of the design of the compression spring 12 with the characteristic line C2, the forces available for switching off the diesel injection pump are clearly greater than when using only one compression spring with a characteristic line which is favorable for the drive slippage regulation. This difference in question can be seen clearly in the aforementioned divergence of the straight line C1*a*, which forms an extension of the straight line C1 from the straight line C2 of the second compression spring 12 which, together with the compression spring 11, forms the spring combination according to the invention.

In addition, it is also noted that a gasoline injection pump or a carburetor, for example, instead of the aforementioned diesel injection pump, can also be used in combination with the described servocylinder unit. In this case, the cylinder 2 likewise serves to regulate a drive torque of a drive motor of a vehicle to a magnitude such that an optimum drive slippage is not exceeded, or not substantially exceeded. As a result, an acceleration which is as high as possible can be achieved with sufficient track keeping of the driven vehicle. The use of the servocylinder unit 2, according to the invention, in connection with gasoline injection pumps or carburetors is available for light-weight vehicles such as light trucks, small buses and passenger motor vehicles. Since a hydraulic pump is occasionally available in such vehicles instead of a compressed air pump, the diameter of the piston 9 can be selected, as needed, so as to be smaller than required when acted upon by compressed air.

While the invention has been illustrated and described as embodied in an apparatus for triggering passenger safety protection systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A servocylinder unit for adjusting an amount of fuel fed to a vehicle drive engine, said servocylinder unit comprising:

a cylinder having a longitudinal axis, a loading chamber at one end thereof, and a part immovably connected with said cylinder at the other end thereof;

a valve arrangement supplying a pressure medium from an injection pump to said piston;

a drive slippage governor connected with said valve arrangement and controlling said valve arrangement;

a piston displaceable in said cylinder under the action of the pressure medium and limiting said loading chamber in said cylinder;

pre-stressed spring means located between a gas pedal and the injection pump and on an opposite side of said piston from said loading chamber for biasing said piston to an initial position thereof and including:

a first spring acting on said piston for enabling regulation of a number of revolutions of the vehicle drive engine, a first stop located in said cylinder for supporting said first spring and displaceable along the longitudinal axis of said cylinder, a second spring extending between said first stop and said part of said cylinder and compressible to enable switching off of fuel feeding, and a second stop fixed to said cylinder and engageble by said first stop under a biasing force of said second spring, said second spring having a higher pre-stress than said first spring and a spring rigidity which is smaller than that of said first spring.

2. A servocylinder unit according to claim 1 wherein said first stop includes an annular member, said servocylinder unit includes a piston rod connected with said piston and extending through said annular member which encircles said piston rod with a clearance.

3. A servocylinder unit according to claim 2 wherein said cylinder has a first bore in which said piston is displaceable and a second bore of a greater diameter than said first bore and coaxial therewith, a shoulder formed as a result of a diameter difference of said first and second bores and forming said second stop.

4. A servocylinder unit according to claim 2 wherein said first stop further includes a bush extending from said annular member toward said piston for limiting compression of said first spring.

* * * * *